US009739166B1

(12) United States Patent
King et al.

(10) Patent No.: US 9,739,166 B1
(45) Date of Patent: Aug. 22, 2017

(54) VTG INTERNAL BY-PASS

(71) Applicant: BorgWarner Inc., Auburn Hills, MI (US)

(72) Inventors: Matthew King, Mars Hill, NC (US); John R. Zagone, Hendersonville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/252,728

(22) Filed: Aug. 31, 2016

(51) Int. Cl.
*F01D 17/16* (2006.01)
*F01D 5/04* (2006.01)

(52) U.S. Cl.
CPC ..... *F01D 17/165* (2013.01); *F01D 5/043* (2013.01); *F05D 2220/40* (2013.01)

(58) Field of Classification Search
CPC ..... F01D 17/165; F01D 5/043; F01D 5/141; F01D 5/142; F01D 25/24; F05D 2250/90; F05D 2260/606; F02B 37/18; F02B 37/183
USPC ..... 415/159, 158, 166, 157
See application file for complete search history.

(56) References Cited

U.S. PATENT DOCUMENTS

| | | | | |
|---|---|---|---|---|
| 6,729,134 | B2 | 5/2004 | Arnold et al. | |
| 7,117,596 | B2 * | 10/2006 | Ohishi | B21H 7/16 29/557 |
| 7,162,872 | B2 | 1/2007 | Schmid et al. | |
| 8,047,772 | B2 | 11/2011 | Petitjean et al. | |
| 8,191,368 | B2 | 6/2012 | Garrett et al. | |
| 8,534,994 | B2 | 9/2013 | Lombard et al. | |
| 8,573,929 | B2 | 11/2013 | Lombard et al. | |
| 8,671,682 | B2 | 3/2014 | Parlow et al. | |
| 2013/0302185 | A1 * | 11/2013 | Gerard | F01D 11/00 417/407 |
| 2015/0004020 | A1 | 1/2015 | Lombard et al. | |
| 2015/0267605 | A1 | 9/2015 | Lombard et al. | |

FOREIGN PATENT DOCUMENTS

WO 2015080920 A1 6/2015

* cited by examiner

*Primary Examiner* — Gregory Anderson
*Assistant Examiner* — Michael Sehn
(74) *Attorney, Agent, or Firm* — BrooksGroup

(57) ABSTRACT

A number of variations may include a method for increasing peak flow in a variable geometry turbine turbocharger comprising: by-passing fluid flow to a turbine impeller by forming at least one internal by-pass passage through at least one of a lower vane ring of a vane pack assembly or a turbine housing below the lower vane ring; providing a first end of a vane component within the at least one internal by-pass passage; and using the first end of the vane component as a rotary valve to control fluid flow through the at least one internal by-pass passage.

17 Claims, 5 Drawing Sheets

VTG INTERNAL BY-PASS

TECHNICAL FIELD

The field to which the disclosure generally relates to includes turbochargers.

BACKGROUND

A variable turbine geometry turbocharger may use vanes in front of a turbine wheel to adjust the geometry of the turbine.

SUMMARY OF ILLUSTRATIVE VARIATIONS

A number of variations may include a variable geometry turbine comprising: a turbine housing comprising a body constructed and arranged to accommodate a turbine wheel, an inlet passage upstream of the body and operatively connected to the body, an outlet passage downstream of the body and operatively connected to the body; a vane pack assembly in operative communication with the turbine inlet passage, wherein the vane pack assembly comprises an upper vane ring, a lower vane ring, and a plurality of vane components interposed between the upper vane ring and the lower vane ring; at least one internal by-pass passage extending through at least one of the lower vane ring or the turbine housing below the lower vane ring, wherein the at least one internal by-pass passage is in operative communication with the inlet passage and the outlet passage; and wherein a first end of the at least one vane component extends within the at least one internal by-pass passage and is constructed and arranged to act as a rotary valve to prevent or allow fluid through the at least one internal by-pass passage.

A number of variations may include a method for increasing peak flow in a variable geometry turbine turbocharger comprising: by-passing fluid flow to a turbine impeller by forming at least one internal by-pass passage through at least one of a lower vane ring of a vane pack assembly or a turbine housing below the lower vane ring; providing a first end of a vane component within the at least one internal by-pass passage; and using the first end of the vane component as a rotary valve to control fluid flow through the at least one internal by-pass passage.

A number of variations may include a method for by-passing fluid flow to a turbine wheel to increase peak flow in a variable geometry turbine turbocharger comprising: providing a turbine comprising a turbine housing having an inlet passage, a body downstream of the inlet passage, an outlet passage downstream of the body, a turbine wheel rotatably attached to the body, a vane pack assembly in operative communication with the inlet passage, wherein the vane pack assembly comprises an upper vane ring, a lower vane ring, and a plurality of vane components interposed between the upper vane ring and the lower vane ring; forming at least one internal by-pass passage through at least one of the lower vane ring or a turbine housing below the lower vane ring, wherein the at least one internal by-pass passage extends from the inlet passage to the outlet passage by-passing the turbine wheel; providing at least one of the plurality of vane components within the at least one internal by-pass passage; using a first end of at least one of the plurality of vane components as a rotary valve; rotating at least one of the plurality of vane components to an open position so that fluid flows through the at least one internal by-pass passage; and rotating at least one of the plurality of vane components to a closed position to prevent fluid from entering into the at least one internal by-pass passage.

Other illustrative variations within the scope of the invention will become apparent from the detailed description provided hereinafter. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

Figure 1:
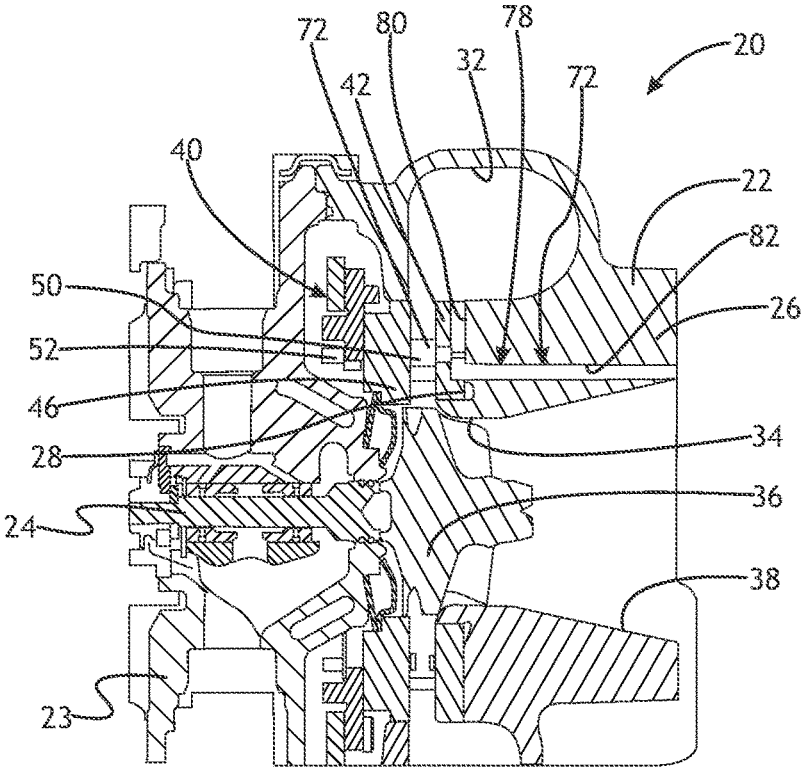
FIG. 1 illustrates a partial section view of a turbocharger according to a number of variations.
Figure 2:
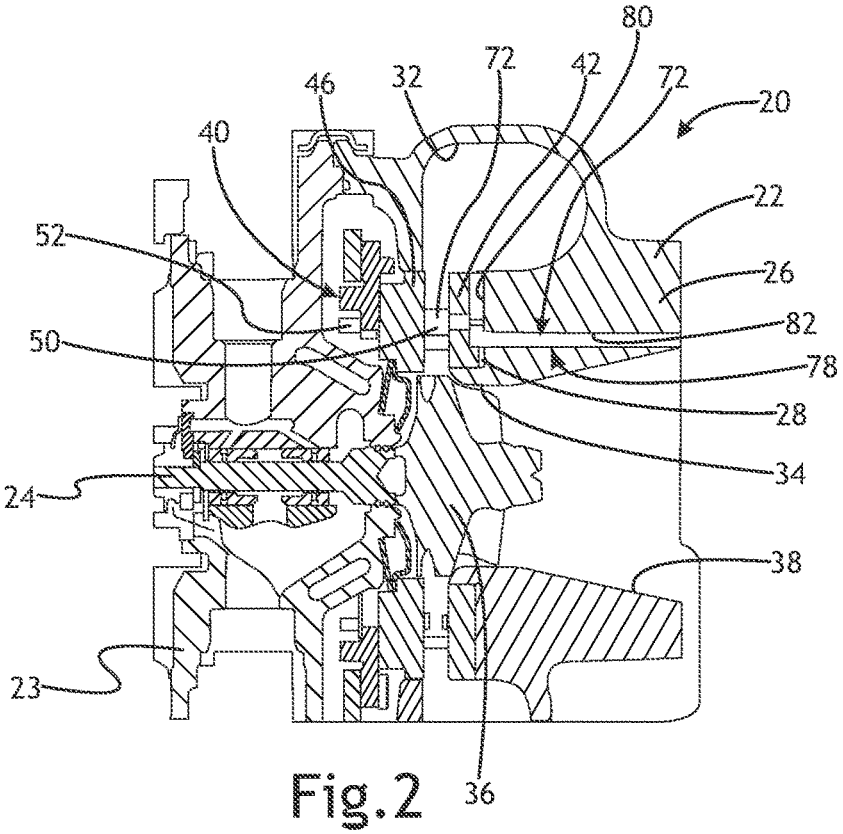
FIG. 2 illustrates a partial section view of a turbocharger according to a number of variations.

Referring to FIGS. 1 and 2, in a number of variations, an engine breathing system may include a variable turbine geometry (VTG) turbocharger 20. A VTG turbocharger 20 may be used to expand the usable flow rate range of an engine while at the same time maintaining a high level of efficiency. The VTG turbocharger 20 may include a variable geometry turbine 22 which may be operatively attached to a compressor 23 via a shaft 24. The variable geometry turbine 22 may include a turbine wheel 36 which may be driven by exhaust gas fluid-flow which may cause the shaft 24 to rotate which may then drive a wheel (not illustrated) in the compressor 23. The compressor 23 may then pressurize air which may enter the internal combustion engine.

In a number of variations, the variable geometry turbine 22 may include a turbine housing 26 having an inlet passage 32 which may accept fluid flow into the turbine 22, a body 34 which may be downstream of the inlet passage 32 and which may house the turbine wheel 36 which may be driven by the flow of fluid, and an outlet passage 38 downstream of the body 34 which may be constructed and arranged to allow fluid flow to exit the variable geometry turbine 22. The variable geometry turbine 22 may be constructed and arranged to vary its geometry using a vane pack assembly 40 which may be located in the inlet passage 32 and may be constructed and arranged to rotate a plurality of vanes 72 in unison to vary the gas swirl angle and inflow speed to regulate the output of the turbine 22.

Figure 3:
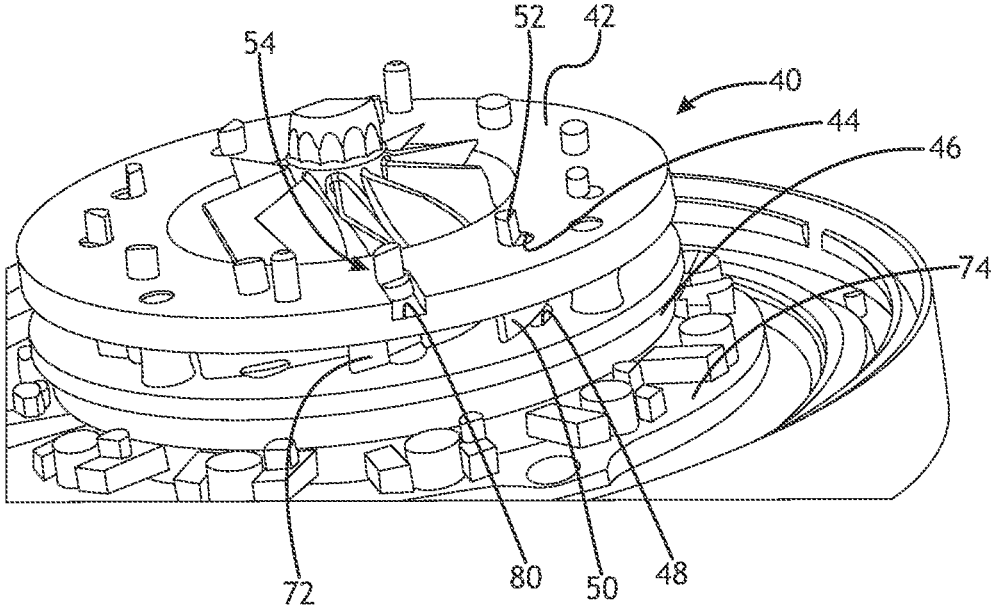
FIG. 3 illustrates a perspective partial view of a turbine according to a number of variations.
Figure 4:
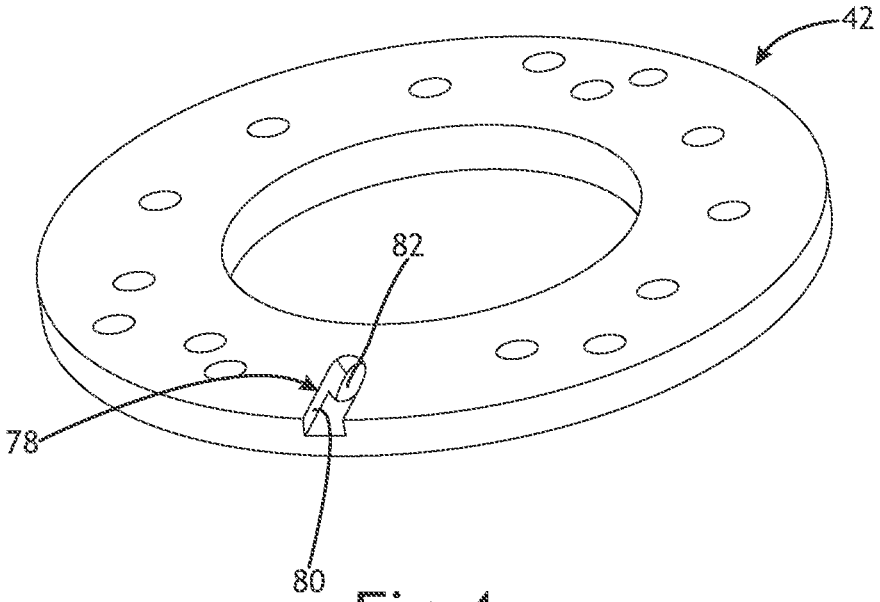
FIG. 4 illustrates a lower vane ring according to a number of variations.
Figure 5:
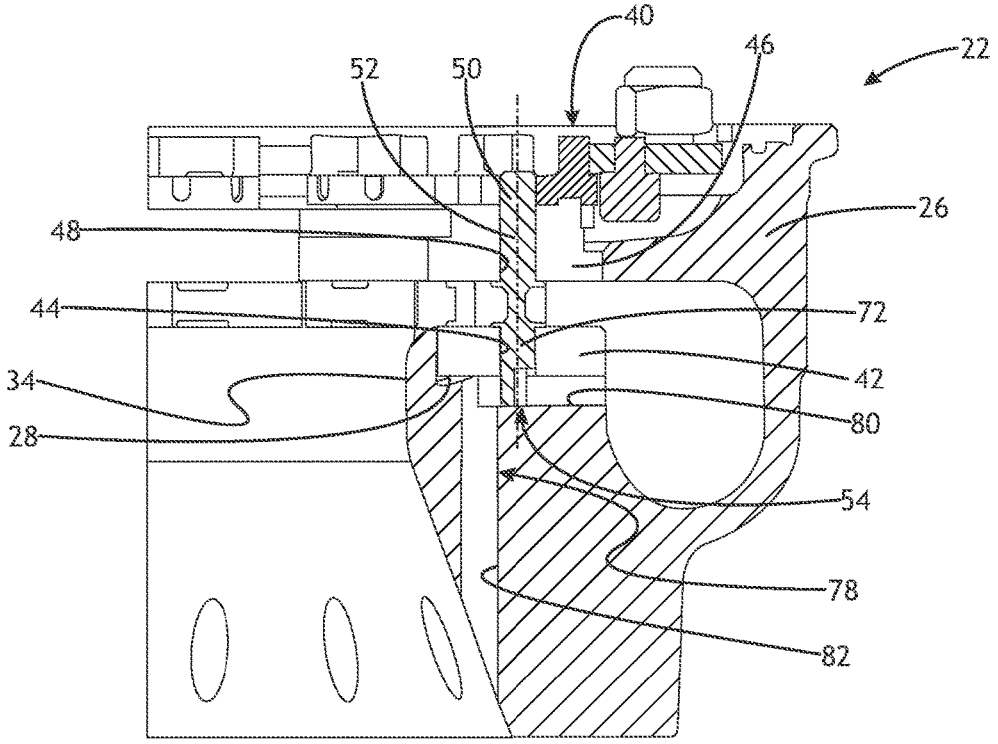
FIG. 5 illustrates a partial section view of a turbine according to a number of variations.
Figure 6:
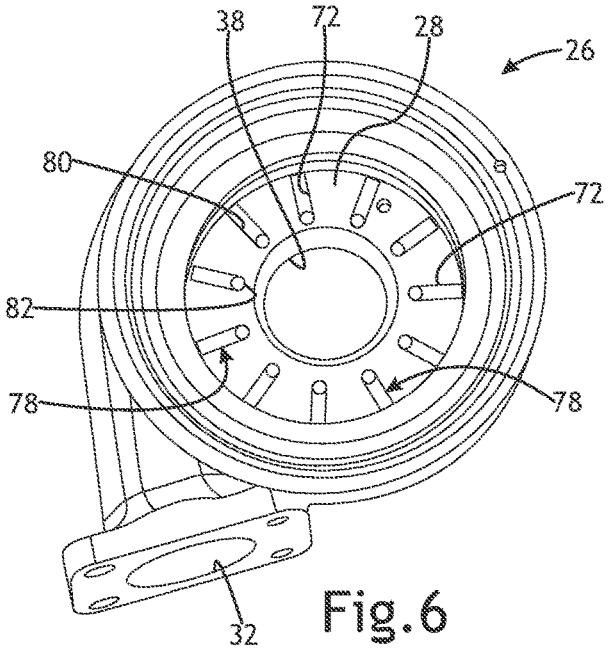
FIG. 6 illustrates a perspective view of a turbine housing according to a number of variations.
Figure 8:
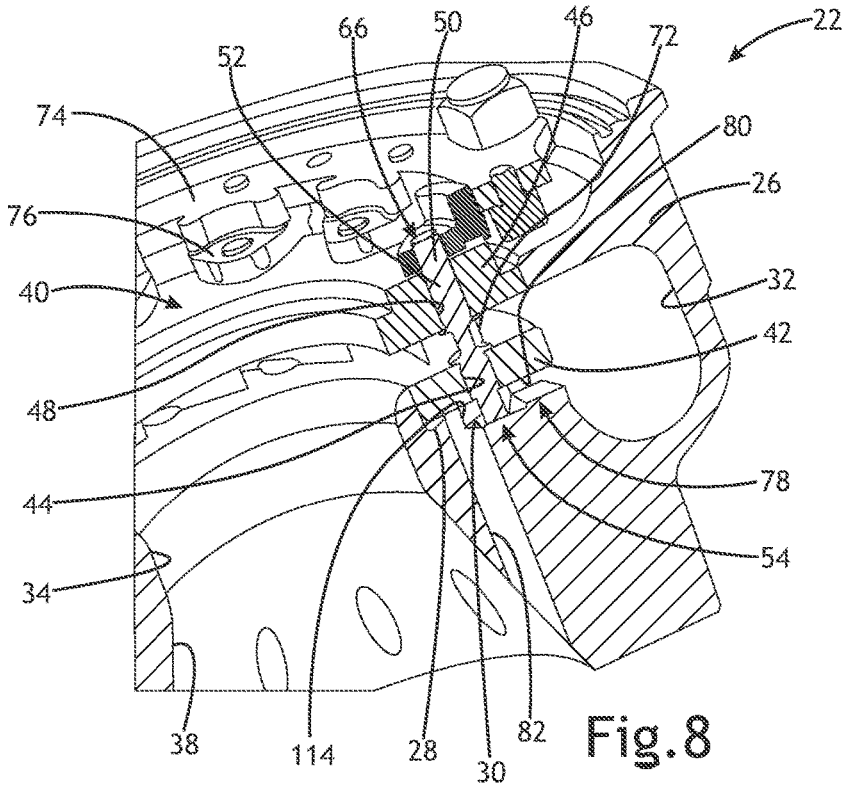
FIG. 8 illustrates a partial section view of a turbine according to a number of variations.
Figure 9:
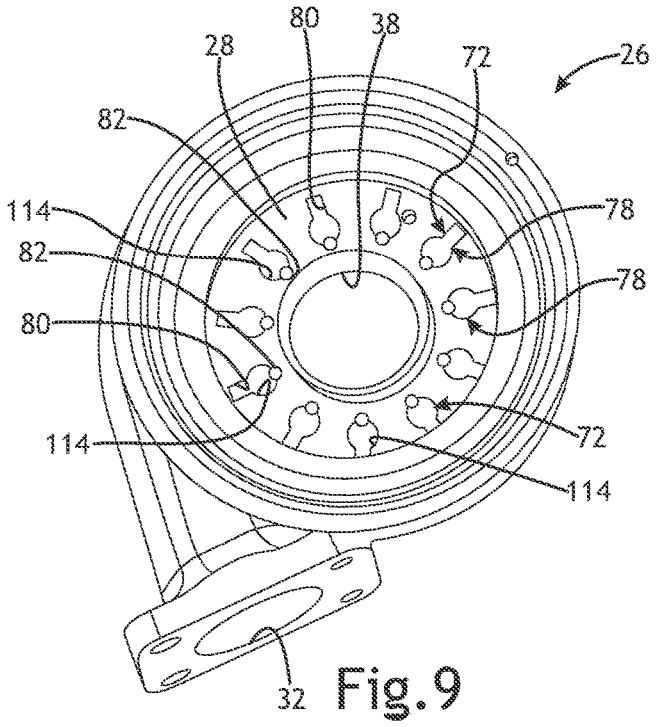
FIG. 9 illustrates a perspective view of a turbine housing according to a number of variations.

Referring to FIGS. 3 and 8, in a number of variations, the vane pack assembly 40 may comprise a lower vane ring 42, an upper vane ring 46, and a plurality of vane components 50 interposed between the lower vane ring 42 and the upper vane ring 46. The turbine housing 26 may be constructed and arranged to provide a seat 28 for the lower vane ring 42, a variation of which is illustrated in FIG. 8. The vane components 50 may each include a vane post 52, and a vane 72 which may rotate with the vane post 52. A first end 54 of the vane post 52 may be constructed and arranged to extend within an opening 44 in the lower vane ring 42 only or may extend within an opening 44 in the lower vane ring 42 and an opening 30 in the turbine housing seat 28. A second end 66 of the vane post 52 may be constructed and arranged to extend through an opening 48 in the upper vane ring 46. In a number of variations, an adjustment ring 74 may extend around the upper vane ring 46.

Referring to FIGS. 1-6 and 8-9, in a number of variations, one or more internal by-pass or wastegate passages 78 may extend within the variable geometry turbine 22 and may be constructed and arranged to direct fluid flow from the inlet passage 32 to the outlet passage 38, bypassing the turbine wheel 36, which may provide an increase of the peak flow at predetermined vane positions. In a number of variations, an internal by-pass passage 78 may include a first portion 80 and a second portion 82. The first portion 80 may be in operative communication with the inlet passage 32 and may be perpendicularly aligned with the axis of rotation of the vane post 52, so that a first end 54 of the vane post 52 may extend within the first portion 80 of the internal by-pass passage 78. The first portion 80 may extend through the turbine housing 26 below the lower vane ring seat 28, variations of which are illustrated in FIGS. 5-6 and 8-9, and/or may extend through the lower vane ring 42, variations of which are illustrated in FIGS. 1-4. In a number of variations, the second portion 82 may be downstream of the vane post 52 and may be in operative communication with the first portion 80 and the turbine outlet passage 38 downstream of the turbine wheel 36. The one or more internal by-pass passages 78 may be any number of configurations including, but not limited to, cylindrical. The first portion 80 and the second portion 82 of the internal by-pass passage 78 may be any number of diameters including, but not limited to, 5 mm. The first portion 80 and the second portion 82 may have the same diameter or may have different diameters. It is noted that internal by-pass passages 78 having a first portion 80 and a second portion 82 are discussed above for illustrative purposes only and that internal by-pass passages 78 may comprise more than two portions without departing from the spirit and scope of the invention.

Figure 7:
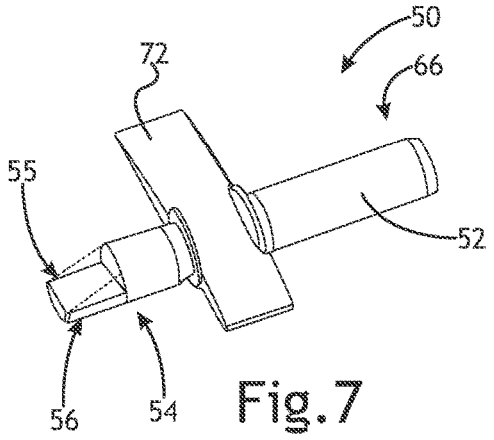
FIG. 7 illustrates a perspective view of a vane component according to a number of variations.
Figure 10:
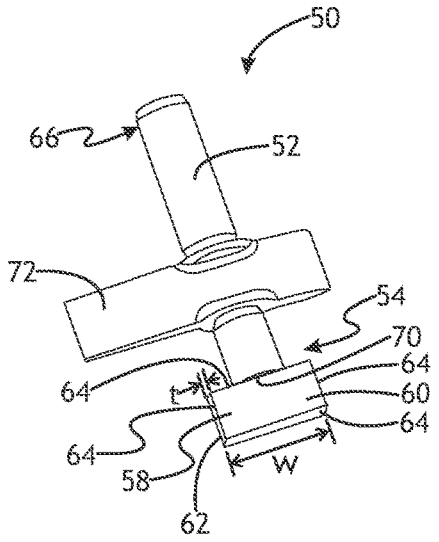
FIG. 10 illustrates a perspective view of a vane component according to a number of variations.
Figure 11:
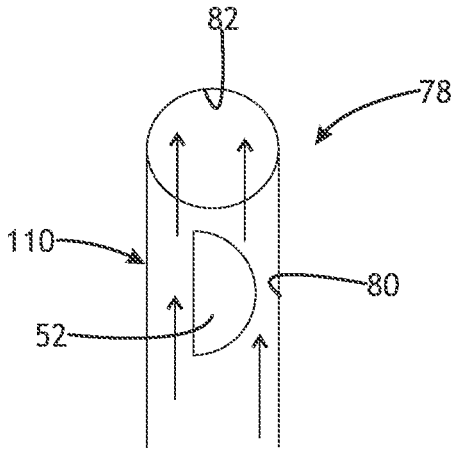
FIG. 11 illustrates a close-up section view of an internal by-pass passage and vane post in an open position according to a number of variations.
Figure 12:
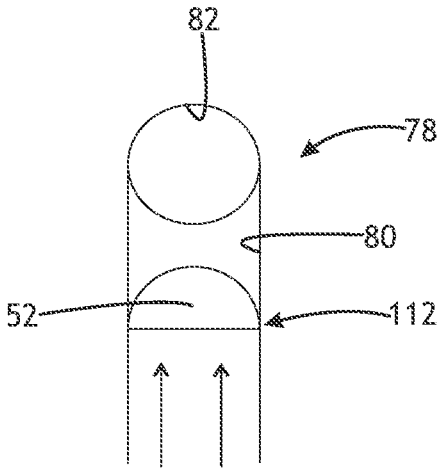
FIG. 12 illustrates a section view of an internal by-pass passage and vane post in a closed position according to a number of variations.

Referring to FIGS. 7, 10, and 11-14 in a number of variations, the first end 54 of the vane posts 52 of the vane components 50 may be constructed and arranged to act as rotary gates or valves which may control the fluid flow allowed into the internal by-pass passage 78. Referring to FIG. 7, in a number of variations, the first end 54 of the vane post 52 may include an opening 56 which may define a rotary gate 55. The opening 56 may be formed in the first end 54 of the vane post 52 or may be cutout or ground after the vane post 52 is formed. In a number of variations, the opening 56 may be perpendicular to the bottom surface of the vane post 52 so that the remaining portion of the first end 54 of the vane post 52 has a semi-circular cross-section, or the first end 54 of the vane post 52 may include an opening which extends at an angle less than 90 degrees to the bottom surface of the vane post 52 so that the remaining portion of the first end 54 is angled or tapers, which may provide a more turned or progressive flow rate control. Referring to FIGS. 11-12, the vane post 52 may be constructed and arranged so that when the vane post 52 is rotated to a first (opened) position 110, a variation of which is illustrated in FIG. 11, the rotary gate 55 of the vane post 52 may be positioned so that the fluid may flow through the opening 56 of the first end 54 of the vane post 52 which may allow fluid to enter into the second portion 82 of the internal by-pass passage 78 and when the vane post 52 is rotated to a second (closed) position 112, a variation of which is illustrated in FIG. 12, the rotary gate 55 may block fluid flow from entering into the second portion 82 of the internal by-pass passage 78. In a number of variations, the amount of fluid flow may also be adjusted by rotating the vane post 52 to angles between the first position 110 and the second position 112.

Figure 13:
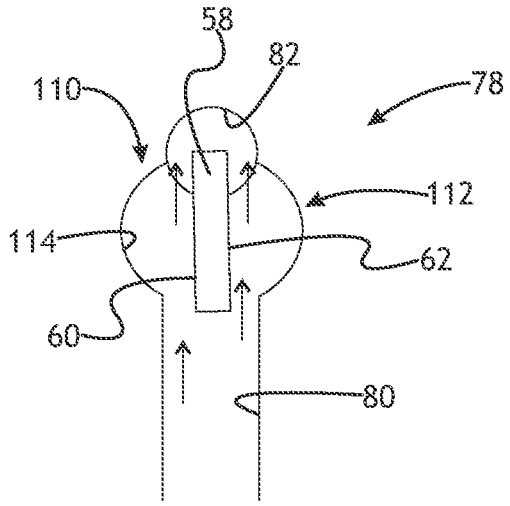
FIG. 13 illustrates a section view of an internal by-pass passage and vane post in an open position according to a number of variations.
Figure 14:
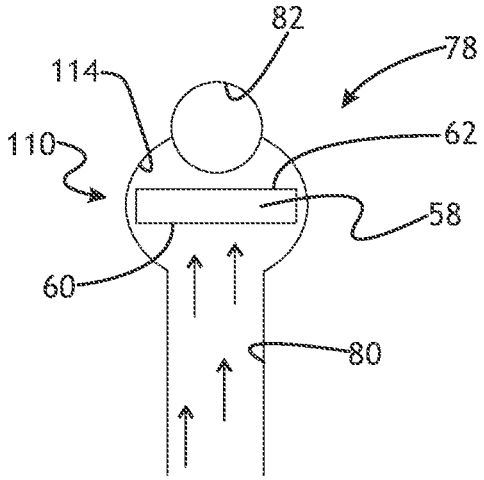
FIG. 14 illustrates a section view of an internal by-pass passage and vane post in a closed position according to a number of variations.

Referring to FIG. 10, in a number of variations, the first end 54 of the vane post 52 of the vane component 50 may include a valve 58 which may be attached to a bottom portion 70 of the vane post 52 including, but not limited to, the bottom surface of the vane post 52. The valve 58 may be formed with the vane component 50 so that it is one single continuous unit with the vane component 50 or may be a separate piece which may be attached to the vane component 50. The valve 58 may include a first face 60 and an opposite second face 62 which may extend the width w of the valve 58, and at least one side surface 64 which may represent the thickness t of the valve 58. Referring to FIGS. 13-14, the first portion 80 of the internal by-pass-passage 78 may include a widened section 114, which may be circular and which may be constructed and arranged to accommodate the valve 58 so that the valve 58 may rotate within the widened section 114. The valve 58 may then be rotated to a first (open) position 110, a variation of which is illustrated in FIG. 13, so that the first and second faces 60, 62 of the valve 58 may be parallel to the flow of fluid so that the fluid may flow through the first portion 80 and into the second portion 82 of the internal by-pass passage 78, and so that when the vane post 52 is rotated to a second (closed) position 112, a variation of which is illustrated in FIG. 14, the flow of fluid may be perpendicular to the first and second face 60, 62 of the valve 58 so that fluid flow may be blocked from entering into the second portion 82 of the internal by-pass passage 78. The valve 58 may be any number of shapes including, but not limited to, rectangular. In a number of variations, the amount of fluid flow through the internal by-pass passage 78 may be adjusted by rotating the valve 58 to angles between the first position 110 and the second position 112.

The variable geometry turbine 22 with one or more internal by-pass passages 78 and rotary vane posts 52 discussed above may allow for peak flow at or near 100% open VTG positions which may allow for smaller frame sizes and may expand the operational range of a VTG turbocharger. The one or more internal by-pass passages 78 and rotary vane posts 52 discussed above may also provide additional variable geometry turbine 22 capability beyond extending the flow range at or near 100%. When aerodynamic performance (turbine efficiency) is increased, driving the exhaust gas recirculation (EGR) may become difficult and in some cases, impossible. By tuning the one or more internal by-pass passages 78 so that they may be open at desired conditions, the turbine efficiency may be reduced to drive the EGR without severe efficiency penalties under various operating conditions.

It is noted that the number of internal by-pass passages 78 and rotary vane posts 52 may vary depending on desired flow parameters required for a particular application. Further, any of the above variations may be combined or rearranged without departing from the spirit and scope of the invention.

The following description of variants is only illustrative of components, elements, acts, products and methods considered to be within the scope of the invention and are not in any way intended to limit such scope by what is specifically disclosed or not expressly set forth. The components, elements, acts, products and methods as described herein may be combined and rearranged other than as expressly described herein and still are considered to be within the scope of the invention.

Variation 1 may include a variable geometry turbine comprising: a turbine housing comprising a body constructed and arranged to accommodate a turbine wheel, an inlet passage upstream of the body and operatively connected to the body, an outlet passage downstream of the body and operatively connected to the body; a vane pack assembly in operative communication with the turbine inlet passage, wherein the vane pack assembly comprises an upper vane ring, a lower vane ring, and a plurality of vane components interposed between the upper vane ring and the lower vane ring; at least one internal by-pass passage extending through at least one of the lower vane ring or the turbine housing below the lower vane ring, wherein the at least one internal by-pass passage is in operative communication with the inlet passage and the outlet passage; and wherein a first end of the at least one vane component extends within the at least one internal by-pass passage and is constructed and arranged to act as a rotary valve to prevent or allow fluid through the at least one internal by-pass passage.

Variation 2 may include a variable geometry turbine as set forth in Variation 1 wherein the first end of the at least one vane component includes a cutout so that the first end of the at least one vane component has a semi-circular cross-section.

Variation 3 may include a variable geometry turbine as set forth in Variation 1 wherein the first end of the at least one vane component is tapered to form the rotary valve.

Variation 4 may include a variable geometry turbine as set forth in Variation 1 wherein the first end of the at least one vane component is attached to a valve.

Variation 5 may include a variable geometry turbine as set forth in any of Variations 1-4 wherein the at least one by-pass passage includes a first portion and a second portion, wherein the at least one vane component extends through the first portion so that the first portion is perpendicular to an axis of rotation of the at least one vane component; and wherein the second portion extends from the first portion downstream of the at least one vane component to the outlet passage downstream of the turbine wheel.

Variation 6 may include a variable geometry turbine as set forth in any of Variations 1-5 wherein the first portion extends through the lower vane ring and the second portion extends through the turbine housing.

Variation 7 may include a variable geometry turbine as set forth in any of Variations 1-5 wherein the first portion and the second portion extend through the turbine housing below the lower vane ring.

Variation 8 may include a variable geometry turbine as set forth in any of Variations 1-5 wherein the first portion extends through the lower vane ring and the turbine housing below the lower vane ring and the second portion extends through the turbine housing.

Variation 9 may include a variable geometry turbine as set forth in any of Variations 1-8 wherein the at least one internal by-pass passage has a circular cross-section.

Variation 10 may include a method for increasing peak flow in a variable geometry turbine turbocharger comprising: by-passing fluid flow to a turbine impeller by forming at least one internal by-pass passage through at least one of a lower vane ring of a vane pack assembly or a turbine housing below the lower vane ring; providing a first end of a vane component within the at least one internal by-pass passage; and using the first end of the vane component as a rotary valve to control fluid flow through the at least one internal by-pass passage.

Variation 11 may include a method as set forth in Variation 10 wherein controlling fluid flow through the at least one internal by-pass passage comprises rotating the vane component to a first position to allow fluid flow through the at least one internal by-pass passage, rotating the vane component to a second position to block fluid flow from passing through the at least one internal by-pass passage; and adjusting the flow of fluid through the at least one internal by-pass passage by rotating the vane component to a third position between the first and the second position.

Variation 12 may include a method as set forth in any of Variations 10-11 further comprising cutting a portion of the first end of the vane component to form the rotary valve.

Variation 13 may include a method as set forth in any of Variations 10-11 further comprising grinding a portion of the first end of the vane component at an angle less than 90 degrees to form the rotary valve.

Variation 14 may include a method as set forth in any of Variations 10-11 further comprising forming a valve in the first end of the vane component to act as the rotary valve.

Variation 15 may include a method as set forth in any of Variations 10-11 further comprising attaching a valve to the first end of the vane component to act as the rotary valve.

Variation 16 may include a method for by-passing fluid flow to a turbine wheel to increase peak flow in a variable geometry turbine turbocharger comprising: providing a turbine comprising a turbine housing having an inlet passage, a body downstream of the inlet passage, an outlet passage downstream of the body, a turbine wheel rotatably attached to the body, a vane pack assembly in operative communication with the inlet passage, wherein the vane pack assembly comprises an upper vane ring, a lower vane ring, and a plurality of vane components interposed between the upper vane ring and the lower vane ring; forming at least one internal by-pass passage through at least one of the lower vane ring or a turbine housing below the lower vane ring, wherein the at least one internal by-pass passage extends from the inlet passage to the outlet passage by-passing the turbine wheel; providing at least one of the plurality of vane components within the at least one internal by-pass passage; using a first end of at least one of the plurality of vane components as a rotary valve; rotating at least one of the plurality of vane components to an open position so that fluid flows through the at least one internal by-pass passage; and rotating at least one of the plurality of vane components to a closed position to prevent fluid from entering into the at least one internal by-pass passage.

Variation 17 may include a method as set forth in Variation 16 further comprising adjusting the flow of fluid through the at least one by-pass passage by rotating at least one of the plurality of vane components between the open position and the closed position.

The above description of select variations within the scope of the invention is merely illustrative in nature and, thus, variations or variants thereof are not to be regarded as a departure from the spirit and scope of the invention.

What is claimed is:

1. A variable geometry turbine comprising:

a turbine housing comprising a body constructed and arranged to accommodate a turbine wheel, an inlet passage upstream of the body and operatively connected to the body, an outlet passage downstream of the body and operatively connected to the body;

a vane pack assembly in operative communication with the turbine inlet passage, wherein the vane pack assembly comprises an upper vane ring, a lower vane ring, and a plurality of vane components interposed between the upper vane ring and the lower vane ring;

at least one internal by-pass passage extending through at least one of the lower vane ring or the turbine housing below the lower vane ring, wherein the at least one internal by-pass passage is in operative communication with the inlet passage and the outlet passage; and wherein a first end of the at least one vane component extends within the at least one internal by-pass passage and is constructed and arranged to act as a rotary valve to prevent or allow fluid through the at least one internal by-pass passage.

2. The variable geometry turbine of claim 1 wherein the first end of the at least one vane component includes a cutout so that the first end of the at least one vane component has a semi-circular cross-section.

3. The variable geometry turbine of claim 1 wherein the first end of the at least one vane component is tapered to form the rotary valve.

4. The variable geometry turbine of claim 1 wherein the first end of the at least one vane component is attached to a valve.

5. The variable geometry turbine of claim 1 wherein the at least one by-pass passage includes a first portion and a second portion, wherein the at least one vane component extends through the first portion so that the first portion is perpendicular to an axis of rotation of the at least one vane component; and wherein the second portion extends from the first portion downstream of the at least one vane component to the outlet passage downstream of the turbine wheel.

6. The variable geometry turbine of claim 5 wherein the first portion extends through the lower vane ring and the second portion extends through the turbine housing.

7. The variable geometry turbine of claim 5 wherein the first portion and the second portion extend through the turbine housing below the lower vane ring.

8. The variable geometry turbine of claim 5 wherein the first portion extends through the lower vane ring and the turbine housing below the lower vane ring and the second portion extends through the turbine housing.

9. The variable geometry turbine of claim 5 wherein the at least one internal by-pass passage has a circular cross-section.

10. A method for increasing peak flow in a variable geometry turbine turbocharger comprising:

by-passing fluid flow to a turbine impeller by forming at least one internal by-pass passage through at least one of a lower vane ring of a vane pack assembly or a turbine housing below the lower vane ring;

providing a first end of a vane component within the at least one internal by-pass passage; and using the first end of the vane component as a rotary valve to control fluid flow through the at least one internal by-pass passage.

11. The method of claim 10 wherein controlling fluid flow through the at least one internal by-pass passage comprises rotating the vane component to a first position to allow fluid flow through the at least one internal by-pass passage, rotating the vane component to a second position to block fluid flow from passing through the at least one internal by-pass passage; and adjusting the flow of fluid through the at least one internal by-pass passage by rotating the vane component to a third position between the first and the second position.

12. The method of claim 10 further comprising cutting a portion of the first end of the vane component to form the rotary valve.

13. The method of claim 10 further comprising grinding a portion of the first end of the vane component at an angle less than 90 degrees to form the rotary valve.

14. The method of claim 10 further comprising forming a valve in the first end of the vane component to act as the rotary valve.

15. The method of claim 10 further comprising attaching a valve to the first end of the vane component to act as the rotary valve.

16. A method for by-passing fluid flow to a turbine wheel to increase peak flow in a variable geometry turbine turbocharger comprising:

providing a turbine comprising a turbine housing having an inlet passage, a body downstream of the inlet passage, an outlet passage downstream of the body, a turbine wheel rotatably attached to the body, a vane pack assembly in operative communication with the inlet passage, wherein the vane pack assembly comprises an upper vane ring, a lower vane ring, and a plurality of vane components interposed between the upper vane ring and the lower vane ring;

forming at least one internal by-pass passage through at least one of the lower vane ring or a turbine housing below the lower vane ring, wherein the at least one internal by-pass passage extends from the inlet passage to the outlet passage by-passing the turbine wheel;

providing at least one of the plurality of vane components within the at least one internal by-pass passage;

using a first end of at least one of the plurality of vane components as a rotary valve;

rotating at least one of the plurality of vane components to an open position so that fluid flows through the at least one internal by-pass passage; and rotating at least one of the plurality of vane components to a closed position to prevent fluid from entering into the at least one internal by-pass passage.

17. The method of claim 16 further comprising adjusting the flow of fluid through the at least one by-pass passage by rotating at least one of the plurality of vane components between the open position and the closed position.

* * * * *